US009664051B2

(12) United States Patent
Bluck et al.

(10) Patent No.: US 9,664,051 B2
(45) Date of Patent: May 30, 2017

(54) ROTOR BLADE ROOT SECTION WITH COOLING PASSAGE AND METHOD FOR SUPPLYING COOLING FLUID TO A ROTOR BLADE

(75) Inventors: Richard Bluck, Welton (GB); Carlos Felipe Favaretto, Kobe (JP); Stuart Stott, North Hykeham (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 778 days.

(21) Appl. No.: 14/125,266

(22) PCT Filed: May 30, 2012

(86) PCT No.: PCT/EP2012/060136
§ 371 (c)(1),
(2), (4) Date: Jan. 13, 2014

(87) PCT Pub. No.: WO2012/171794
PCT Pub. Date: Dec. 20, 2012

(65) Prior Publication Data

US 2014/0178198 A1 Jun. 26, 2014

(30) Foreign Application Priority Data

Jun. 16, 2011 (EP) ..... 11170168

(51) Int. Cl.
*F01D 5/08* (2006.01)
*F01D 5/18* (2006.01)

(52) U.S. Cl.
CPC ..... *F01D 5/081* (2013.01); *F01D 5/187* (2013.01); *F05D 2250/71* (2013.01)

(58) Field of Classification Search
CPC . F01D 5/081; F01D 5/08; F01D 5/187; F05D 2250/70; F05D 2250/71; F05D 2260/20
See application file for complete search history.

(56) References Cited

U.S. PATENT DOCUMENTS 2,641,439 A 6/1953 Williams
5,975,850 A 11/1999 Abuaf
(Continued)

FOREIGN PATENT DOCUMENTS

EP 1365108 11/2003
EP 1533474 5/2005
(Continued)

*Primary Examiner* — Craig Kim
*Assistant Examiner* — Brian P Wolcott
(74) *Attorney, Agent, or Firm* — Beusse Wolter Sanks & Maire

(57) ABSTRACT

A root section of a rotor blade for interacting with working fluid upon rotating the rotor blade is provided. The root section includes a curved cooling passage for guiding a cooling fluid within the root section. A cooling fluid entry plenum has an entry aperture for introducing the cooling fluid into the cooling passage. A platform is located at a radially outer end of the root section. The curved cooling passage penetrates through the platform, and the following condition is satisfied at least in a portion of a radial extent of the cooling passage: 0.25*dr<rc<1.5*dr, where dr is a radial distance in the radial direction between the platform of the root section and the aperture of the entry plenum and rc is the radius of curvature of the curved cooling passage.

18 Claims, 3 Drawing Sheets

(56) References Cited

U.S. PATENT DOCUMENTS

| | | | | |
|---|---|---|---|---|
| 6,092,991 | A | 7/2000 | Ichiryu | |
| 7,125,225 | B2 * | 10/2006 | Surace | F01D 5/16 416/224 |
| 8,267,662 | B2 * | 9/2012 | Patrick | F01D 5/26 416/146 R |
| 2006/0153679 | A1 * | 7/2006 | Liang | F01D 5/081 416/97 R |
| 2007/0212228 | A1 * | 9/2007 | Digard Brou De Cuissart | F01D 5/082 416/97 R |

FOREIGN PATENT DOCUMENTS

| | | |
|---|---|---|
| EP | 1234949 | 2/2006 |
| EP | 1793085 | 6/2007 |
| EP | 2236746 | 10/2010 |
| GB | 2225063 | 5/1990 |
| JP | 57013201 | 1/1982 |

* cited by examiner

ROTOR BLADE ROOT SECTION WITH COOLING PASSAGE AND METHOD FOR SUPPLYING COOLING FLUID TO A ROTOR BLADE

CROSS REFERENCE TO RELATED APPLICATIONS

This application is the U.S. National Stage of International Application No. PCT/EP2012/060136 filed May 30, 2012, and claims the benefit thereof. The International Application claims the benefit of European Application No. EP11170168 filed Jun. 16, 2011. All of the applications are incorporated by reference herein in their entirety.

FIELD OF INVENTION

The present invention relates to a root section of a rotor blade, to a rotor blade, to a rotor blade arrangement and to a method for supplying a cooling fluid to a rotor blade. In particular, the present invention relates to a rotor blade root section, to a rotor blade, to a rotor blade arrangement and to a method for supplying a cooling fluid to a rotor blade, wherein supply of a cooling fluid, in particular compressed air, to an inside of the rotor blade is enabled and wherein a pressure loss of the cooling fluid occurring upon supplying the cooling fluid to the rotor blade is reduced.

BACKGROUND

A turbine and compressor section within a turbomachine, such as a gas turbine, may include a rotor assembly comprising a rotating disk (rotating around a rotation axis provided by a rotor shaft) and a plurality of rotor blades circumferentially disposed around the disk and connected to the disk. Each rotor blade may comprise a root section, an airfoil section and a platform positioned in a transition area between the root section and the airfoil section. The root section of a blade may be received in complementary shaped recesses within the disk for mechanically mounting the rotor blade. The platform of the blade may laterally extend outwards and collectively may form a flow path of a working fluid passing through the rotor stage. The working fluid may flow primarily along the axial direction which may be defined as the direction of the rotation axis.

The rotor blade may be situated in a compressor stage of a turbine stage of the gas turbine.

The rotor blade comprises the airfoil section which impacts or is in contact with the working fluid to compress the working fluid upon rotation of the rotor blade (when the rotor blade is in the compressor section) or is driven by working fluid to cause rotation of the rotor blade (when the rotor blade is in the turbine section). During compression of the working fluid or impacting of the high temperature working fluid discharged from a combustor the rotor blade, in particular the airfoil section of the rotor blade, may receive heat energy causing the rotor blade, in particular the airfoil section of the rotor blade, to heat up. In order to carry away heat energy, the airfoil section of the rotor blade may be internally cooled using a cooling fluid, such as a gas, for example steam or compressed cooling air. For this purpose, the cooling fluid must be supplied to an inside of the airfoil section of the rotor blade.

U.S. Pat. No. 6,092,991 discloses a gas turbine blade having a platform and a turbine wheel plate in which cooling passages are arranged in a plurality of rows and connected to one another in a blade trunk section of a moving blade and a supply side passage and a discharge-side passage are formed in a blade root section.

U.S. Pat. No. 2,641,439 discloses a blank, from which a turbine blade is to be formed, wherein the blank includes a root portion having an opening for introducing cooling air into grooves of the blade. Three ridges run as far as the outer end of the opening, where they terminate and their upper surfaces merge with the surface of the blank.

U.S. 2006/0153679 A1 discloses cooling channels for directing cooling fluid through the turbine blade to remove excess heat to prevent premature failure.

It has been observed that cooling of a rotor blade, in particular an airfoil section of a rotor blade, requires a large amount of cooling fluid or may be ineffective either resulting in a decreased efficiency of the gas turbine or leading to damages to the rotor blades due to excess heating of the rotor blades during operation of the gas turbine.

There may be a need for a root section of a rotor blade, for a rotor blade, for a rotor blade arrangement and for a method for supplying a cooling fluid to a rotor blade, in particular to be used in a turbine stage of a gas turbine, wherein the efficiency of the cooling is increased and wherein damages to the rotor blade may be avoided.

SUMMARY OF THE INVENTION

According to an embodiment of the present invention, a root section (a portion of the rotor blade representing a radially inner part of the rotor blade) of a rotor blade (in particular for a gas turbine, in particular for a turbine section of a gas turbine) for interacting (in particular receiving rotational energy from the impacting working fluid, which may be a burnt mixture of fuel and air discharged from a combustor) with working fluid (in particular a burnt mixture of a oxidant and fuel, in particular causing rotating the rotor blade about a rotation axis which may be provided by a rotation shaft oriented in an axial direction, the axial direction being directed to point in a downstream direction of the working fluid), the working fluid streaming in the axial direction (and possibly also in a circumferential direction), is provided. Thereby, the root section of the rotor blade comprises a curved (i.e. not straight) cooling passage (having any cross-sectional shape, such as a circular cross-sectional shape, an elliptical cross-sectional shape, a rectangular cross-sectional shape) in an inside of the root section (wherein the root section in particular may be an integrally formed part, in particular manufactured by precision casting, layered object manufacturing, stereolithograpy or laser sintering) for guiding (or leading or containing) a cooling fluid (in particular compressed gas delivered by a compressor) within the root section from a radially inner end (representing an end closest to the rotor shaft) of the root section to a radially outer end (representing a portion farthest away from the rotor shaft) of the root section, wherein a radial direction is perpendicular to the axial direction, wherein the radial direction points away from the rotation axis. Further, the root section of the rotor blade comprises a cooling fluid entry plenum (a space within the root section or at least partially surrounded by the root section, the cooling fluid entry plenum providing a space for distributing cooling fluid supplied to the cooling fluid entry plenum to one or more portions of the curved cooling passage) having an entry aperture (in particular providing an opening to the inside of the root section and thus to the inside of the curved cooling passage) arranged at the radially inner end of the root section for introducing the cooling fluid (in particular from a supply conduit comprised in a disk to which the root section is mechanically connected, i.e. via a fir tree shaped fastening mechanism) into the cooling passage. Further, the root section of the rotor blade comprises a platform located at a radially outer end of the root section, the platform being in contact with the working fluid, wherein the curved cooling passage penetrates through the platform. During operation of the gas turbine the working fluid may stream along the platform and may transfer rotational energy to the rotor blade causing the rotor shaft to rotate. Further, the following condition is satisfied in a portion of between 70% and 100% of a radial extent (or an entire extent in the root section) of the cooling passage: $0.25*dr<rc<1.5*dr$, wherein dr is a radial distance (a distance between radial positions) in the radial direction between the platform (or a radially outer end thereof) of the root section and the aperture (located at the radially inner end of the root section) of the entry plenum and rc is the radius of curvature (the curvature may be represented as the reciprocal of the radius of curvature) of the curved cooling passage.

In particular, the radius of curvature of the curved cooling passage may be defined as the radius of curvature of a center line within the curved cooling passage, the radius of curvature of an upstream borderline or a downstream borderline of the curved cooling passage. Further, the radius of curvature of the curved cooling passage may relate to a radius of curvature of a line within the cooling passage at which a flow velocity of the cooling fluid within the curved cooling passage is maximal.

In particular, a center of curvature may be arranged axially upstream of the cooling passage and arranged radially in between the radially outer end and radially inner end of the root section.

The curved cooling passage within the root section of the rotor blade provides a means by which cooling fluid, in particular cooling air may be fed into the internal passages of the airfoil section of the blade, in order to cool the turbine blade airfoil which is exposed to the high temperature of the working fluid. Therefore, in particular it may be avoided to heat the blade material to such a degree that the risk occurs that the oxidation range or melting point of the blade material is reached.

The curved cooling passage provides a conduit for guiding the cooling fluid such that a pressure loss during guiding the cooling fluid through the curved cooling passage may be reduced compared to a conventional root section of a rotor blade. In particular, changes in the direction of the flow of the cooling fluid may be kept smooth or below a threshold (below a threshold deviation or deflection angle) such that the cooling fluid may flow without an extensive degree of turbulence, in order to reduce the pressure loss.

In particular, the larger the radial distance in the radial direction between the platform of the root section and the aperture of the entry plenum, the greater the radius of curvature of the curved cooling passage may be. In particular, the radius of curvature of the curved cooling passage may be (at least approximately) constant or may vary along an extent of the curved cooling passage between 0% and 30%, in particular between 0% and 10%, in particular in at least 80% of an extent of the curved cooling passage. Thereby, the flow of the cooling fluid may be in particular smooth avoiding excessive turbulences, in order to reduce the pressure loss. Thereby, an amount of energy required to generate the compressed cooling fluid and supply the cooling fluid to the rotor blade may be reduced, in order to thus increase the efficiency of the gas turbine in which the root section of the rotor blade is installed.

Further, the cooling fluid is guided (or led or directed) within the cooling passage (in particular by a border or borders of the cooling passage) from the radially inner end to the radially outer end of the root section such that the cooling fluid has a movement component (which may for example be represented as a velocity vector component) in the axial direction (e.g. a z-axis of a cylinder coordinate system) and also a movement component in the radial direction (e.g. along a r-coordinate in the cylinder coordinate system) in a first portion (representing a radially inner portion) of the cooling passage, such that the cooling fluid has a movement component only in the radial direction (but not in the axial direction) in a second portion (which may represent a center portion or radially intermediate portion of the cooling passage) of the cooling passage, and such that the cooling fluid has a movement component in a direction opposite to the axial direction and also has a movement component in the radial direction in a third portion (which may represent a radially outer portion) of the cooling passage.

Thus, the cooling fluid flows in all three portions of the cooling passage, i.e. the first portion, the second portion and the third portion of the cooling passage, in the radial direction (i.e. away from the rotation axis). However, the cooling fluid may flow along the axial direction (i.e. in a direction downstream when expressed relating to a flow direction of the working fluid) only in the first portion of the cooling passage but not in the second portion of the cooling passage and not in the third portion of the cooling passage. Further, only in the third portion of the cooling passage the cooling fluid may flow in the direction opposite to the axial direction. As a net result of the guiding the cooling fluid through the cooling passage the cooling fluid may have moved primarily in the radial direction (outwards) but may not have moved in the axial direction, since an entry port of the first portion of the cooling passage may have a same axial position as an exit port of the third portion of the cooling passage.

By configuring the cooling passage such that the cooling fluid has a movement component in the axial direction in the first portion of the cooling passage and such that the cooling fluid has a movement component in a direction opposite to the axial direction in the third portion of the cooling passage, it is facilitated to introduce cooling fluid via a cooling supply conduit which includes an angle $\alpha$ with the radial direction, wherein $\alpha$ may for example amount to between 45° and less than 90°. Thereby, a smooth introduction of the cooling fluid without causing excessive turbulence may be achieved. However, maintaining the movement component in the axial direction would transfer the cooling fluid to an axial position farther downstream than a position where the rotor blade is actually located. Thus, by bending the cooling passage back such that the cooling fluid is caused to adapt a movement in a direction opposite to the axial direction the cooling fluid may be lead back to an axial position where the rotor blade, in particular its cooling passages, are actually located. Thereby, effective cooling of the rotor blade by introducing cooling fluid without introducing excessive turbulence is enabled.

Thereby, the pressure loss occurring during leading the cooling fluid through the cooling passage may further be decreased, in order to improve the efficiency of the gas turbine.

According to an embodiment of the present invention, a portion of between 70% and 100%, in particular between 90% and 100%, of a radial extent (orentire extent) of the cooling passage is located in a single azimuthal (or circumferential) plane. An azimuthal plane may be defined as a set of points which all have the same circumferential position or azimuthal position (e.g. represented by a same ϕ-coordinate of the cylinder coordinate system) in a cylinder coordinate system, wherein the rotation axis represents the z-axis. Thereby, the flow of the cooling fluid may be smooth, in order to avoid unnecessary turbulences. Further, the cooling passage may be manufactured in a simple manner.

According to an embodiment of the present invention, the cooling passage comprises an (axially) upstream cooling passage and a (axially) downstream cooling passage, the downstream cooling passage being located axially downstream from the upstream cooling passage.

In particular, the upstream cooling passage and the downstream cooling passage may supply the cooling fluid to a cooling channel system within the airfoil section of the rotor blade which may be separated from each other or which may join each other within the airfoil section of the rotor blade. The cooling fluid may be exhausted at a tip or at a trailing edge of the airfoil section of the rotor blade. Thus, the cooling fluid may have a substantially same flow direction when flowing in the upstream cooling passage and the downstream cooling passage radially outwards. In particular, the upstream cooling passage and the downstream cooling passage may be curved in a similar manner having a similar size but being shifted relative to each other in the axial direction leaving an axial distance between them. By providing the upstream cooling passage and the downstream cooling passage an amount of cooling fluid supplied to the airfoil section of the rotor blade may be increased and a distribution of the cooling fluid may be improved. The upstream cooling passage and the downstream cooling passage may lie in a common circumferential plane.

According to an embodiment of the present invention, the upstream cooling passage and the downstream cooling passage have cross-sectional areas at same radial positions, which are (at least approximately) constant or differ by between 0% and 20%, in particular between 0% and 10%, wherein the cross-sectional area of the upstream cooling passage varies along the radial extent (orentire extent) of the upstream cooling passage between 25% and 0%, in particular between 10% and 0%, of an average cross-sectional area of the upstream cooling passage taken along the entire extent of the upstream cooling passage.

By providing the upstream cooling passage and the downstream cooling passage with cross-sectional areas being the same it may be possible to distribute the cooling fluid in a more homogeneous manner. Further, when the cross-sectional area of the upstream cooling passage and/or the downstream cooling passage does not vary in an excessive way, the cooling fluid may flow with a velocity (and/or pressure) that does not change to a large degree leading to a more laminar flow reducing pressure losses.

According to an embodiment of the present invention, the entry aperture has a shape being elongated in the axial direction to have an axial width (an axial distance between material delimiting the entry aperture) being between 1.2 and 2.0 times greater than a circumferential width of the entry aperture, wherein the entry aperture tapers (reducing its circumferential width) in the axial direction such that a circumferential width of the entry aperture decreases in the axial direction such that in particular the circumferential width of the entry aperture at a downstream end of the entry aperture amounts to between 0.9 to 0.4, in particular 0.6 to 0.5, of a circumferential width of the entry aperture at an upstream end of the entry aperture.

To provide for an entry aperture having the elongated shape being elongated in the axial direction, thus being in particular longer in the axial direction than in the circumferential direction may allow to supply the upstream cooling passage and the downstream cooling passage which are spaced apart in the axial direction with the cooling fluid such that about a same amount of cooling fluid enters the upstream cooling passage and the downstream cooling passage. Thereby, a cooling efficiency of the cooling of the airfoil section of the rotor blade may be improved. In particular, when the entry aperture tapers (i.e. decreases its circumferential width) in the axial direction, loss of cooling fluid may be reduced in particular when the cooling fluid is supplied from a disk supply conduit which is axially spaced closer to the upstream cooling passage than to the downstream cooling passage.

According to an embodiment of the present invention, the axial width of the entry aperture deviates from an axial distance, determined at a same radial position, between an upstream border of the upstream cooling passage and a downstream border of the downstream cooling passage between 0% and 30% of the axial distance between the upstream border of the upstream cooling passage and the downstream border of the downstream cooling passage.

In particular, the axial width of the entry aperture may thus be dimensioned to be substantially equal to the overall axial width of the upstream border of the upstream cooling passage and the downstream border of the downstream cooling passage. Thereby, the cooling fluid may be effectively supplied into the upstream cooling passage and the downstream cooling passage. In particular, it may be avoided that swirling occurs or that excessive turbulence occurs, in order to improve the efficiency of the cooling.

According to an embodiment of the present invention, the cooling fluid entry plenum and the entry aperture are delimited by a plenum upstream border which joins with the upstream border of the upstream cooling passage and are delimited by a plenum downstream border which joins with the downstream border of the downstream cooling passage, wherein the plenum upstream border includes an angle with the axial direction which is greater than an angle which the plenum downstream border includes with the axial direction.

In particular, the plenum upstream border may be material of the root section delimiting the entry plenum towards an upstream side of the entry plenum. In particular, the plenum downstream border may be material of the root section of the rotor blade delimiting the fluid entry plenum at the downstream side of the entry plenum. In particular, when supplying the cooling fluid via a disk cooling conduit (wherein the root section is mechanically connected to the disk) the cooling fluid may exit the supply conduit of the disk at an angle which may correspond (or be substantially equal to) the angle at a radially inner end of the upstream cooling passage which may in particular align with the cooling supply conduit of the disk.

The cooling fluid to be supplied to the downstream cooling passage may have to change its moving direction after exiting from the supply conduit of the disk to increase its axial movement component (compared to its radial movement component) in order to reach the entry of the downstream cooling passage, where it may have again to change its moving direction to increase the radial component of the moving direction (compared to the axial component of the moving direction) in order to adapt its moving direction to match (at least approximately) the extension direction of the downstream cooling passage. In order to change its moving direction it may be advantageous to provide the plenum downstream border with an angle with the axial direction which is smaller than the angle which is included between the plenum upstream border and the axial direction.

According to an embodiment of the present invention, the plenum upstream border includes an angle with the axial direction between 65° and 80°, wherein the plenum downstream border includes an angle with the axial direction between 35° and 60°. Thereby, the cooling fluid may be led or supplied to the upstream cooling passage as well as to the downstream cooling passage, while avoiding extensive turbulence for reducing a pressure loss and improving the efficiency of the cooling system.

According to an embodiment of the present invention, the cooling fluid entry plenum is radially outwards delimited by a plenum central border (in particular arranged between the upstream cooling passage and the downstream cooling passage, in particular axially between the cooling passages), wherein the plenum central border joins a downstream border of the upstream cooling passage at an upstream fillet radius of curvature, wherein the plenum central border joins an upstream border of the downstream cooling passage at a downstream fillet radius of curvature, wherein the downstream fillet radius of curvature is between 1.5 times and 5 times, in particular between 2 times and 3 times, greater than the upstream fillet radius of curvature.

When the downstream fillet radius of curvature (in particular delimiting the downstream cooling passage at an upstream side and at a radially inner side) is designed to be larger than the upstream fillet radius of curvature, the cooling fluid may flow in a smooth way from within the plenum to the downstream cooling passage, while reducing pressure loss.

According to an embodiment of the present invention, the following condition is satisfied: $0.5*dr<rc<1.25*dr$.

Thereby, the flow of the cooling fluid through the cooling passage (in particular through the upstream cooling passage and the downstream cooling passage) may further be improved regarding avoidance of excessive turbulence or swirling. In particular, the condition may be applied to the upstream cooling passage as well as to the downstream cooling passage.

According to an embodiment, it is provided a rotor blade for compressing working fluid upon rotating about a rotation axis oriented in an axial direction, the working fluid streaming in the axial direction, the rotor blade comprising a root section as described according to an embodiment above; an airfoil section provided (in particular fastened at or integrally formed with the platform and/or the root section) at the radially inner end of the root section and extending (primarily) in the radial direction, the airfoil section being arranged for interaction with the working fluid.

The airfoil section may internally comprise a conduit system for guiding the cooling fluid through an inside of the airfoil section, in order to cool the airfoil section which may be subjected to high temperatures of the working gas during operation of the gas turbine. The cooling fluid may enter the airfoil section through the upstream cooling passage as well as through the downstream cooling passage and the cooling air after absorbing some heat from the airfoil section may exit the inside of the airfoil section through one or more exhaust holes at the tip of the airfoil section and/or at a trailing edge of the airfoil section.

According to an embodiment of the present invention, it is provided a rotor blade arrangement, comprising a rotor blade according to an embodiment as described above; a disk connectable to a rotor shaft, the disk comprising a cooling supply conduit for supplying the cooling fluid into the cooling passage, in particular the upstream cooling passage, of the root section of the rotor blade; wherein the rotor blade is mechanically connected (in particular via fir tree complementary shapes) to the disk via the root section of the rotor blade such that the plenum upstream border and a supply conduit upstream border align.

In particular, the supply conduit may be arranged and shaped such that a moving direction of the cooling fluid exiting the supply conduit aligns with a moving direction of the cooling fluid in (or a center line of) the upstream cooling passage. In particular, a center line of the supply conduit may be extended to coincide with a center line of the upstream cooling passage, in order to ensure that the cooling fluid supplied by the supply conduit of the disk smoothly enters into the upstream cooling passage without substantially changing its moving direction. Further, the cooling fluid entry plenum may be shaped such that a portion of the cooling fluid supplied by the supply conduit of the disk is also guided into the downstream cooling passage without causing extensive swirling or turbulence.

According to an embodiment of the present invention, the orientation (or inclination relative to the axial direction) of the cooling supply conduit (in particular a center line of the cooling supply conduit) of the disk aligns with, in particular deviates between 0° and 10° from, an orientation (or inclination relative to the axial direction) of the upstream cooling passage (or a center line of the upstream cooling passage or a border of the upstream cooling passage) of the root section of the rotor blade. Thereby, smooth supply of the cooling fluid from the supply conduit of the disk to the upstream cooling passage may be ensured.

According to an embodiment of the present invention, it is provided a method for supplying a cooling fluid to a rotor blade, the rotor blade being adapted for interacting with working fluid upon rotating about a rotation axis oriented in an axial direction, the working fluid streaming in the axial direction, the method comprising guiding the cooling fluid within a curved cooling passage in an inside of a root section of the rotor blade from a radially inner end of the root section to a radially outer end of the root section, wherein a radial direction is perpendicular to the axial direction pointing away from the rotation axis; introducing the cooling fluid into the cooling passage via a cooling fluid entry plenum having an entry aperture arranged at the radially inner end of the root section; and leading the cooling fluid through a platform located at a radially outer end of the root section, the platform being in contact with the working fluid, wherein the curved cooling passage penetrates through the platform, wherein the following condition is satisfied in a portion of between 70% and 100% of a radial extent of the cooling passage: $0.25*dr<rc<1.5*dr$, wherein dr is a radial distance in the radial direction between the platform of the root section and the aperture of the entry plenum and rc is the radius of curvature of the curved cooling passage. Thereby, the cooling fluid is guided within the cooling passage from the radially inner end to the radially outer end of the root section such that the cooling fluid has a movement component (237) in the axial direction and a movement component (239) in the radial direction in a first, radially inner portion of the cooling passage, the cooling fluid has a movement component only in the radial direction in a second, radially middle portion of the cooling passage, and the cooling fluid has a movement component in a direction opposite to the axial direction and in the radial direction in a third, radially outer portion of the cooling passage.

It should be noted that features (individually or in any combination) disclosed, described, explained, applied for or employed for a root section of a rotor blade, a rotor blade or a rotor blade arrangement may also be applied to a method for supplying a cooling fluid to a rotor blade according to an embodiment of the present invention and vice versa.

According to an embodiment, a gas turbine is provided comprising a rotor blade arrangement according to an embodiment of the present invention. The gas turbine further may comprise a combustor for burning a fuel which has been mixed with an oxidant, particularly a compressed oxidant. The burnt mixture may interact with the rotor blade, in order to drive the rotor blade. The rotor blade is internally cooled by the cooling fluid supplied from the supply conduit of the disk through the cooling passages of the root section of the rotor blade and towards the airfoil section of the rotor blade. The oxidant, e. g. compressed air, may be generated by a rotating rotor blade (in a compressor stage of the gas turbine) or an external compressor.

It has to be noted that embodiments of the invention have been described with reference to different subject matters.

In particular, some embodiments have been described with reference to method type claims whereas other embodiments have been described with reference to apparatus type claims. However, a person skilled in the art will gather from the above and the following description that, unless other notified, in addition to any combination of features belonging to one type of subject matter also any combination between features relating to different subject matters, in particular between features of the method type claims and features of the apparatus type claims is considered as to be disclosed with this document.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

BRIEF DESCRIPTION OF THE DRAWINGS

An embodiment of the present invention is now described with reference to the accompanying drawings. In the drawings elements or features which are similar in structure and/or function are denoted with similar reference signs differing only in the first digit.

DETAILED DESCRIPTION

Figure 1:
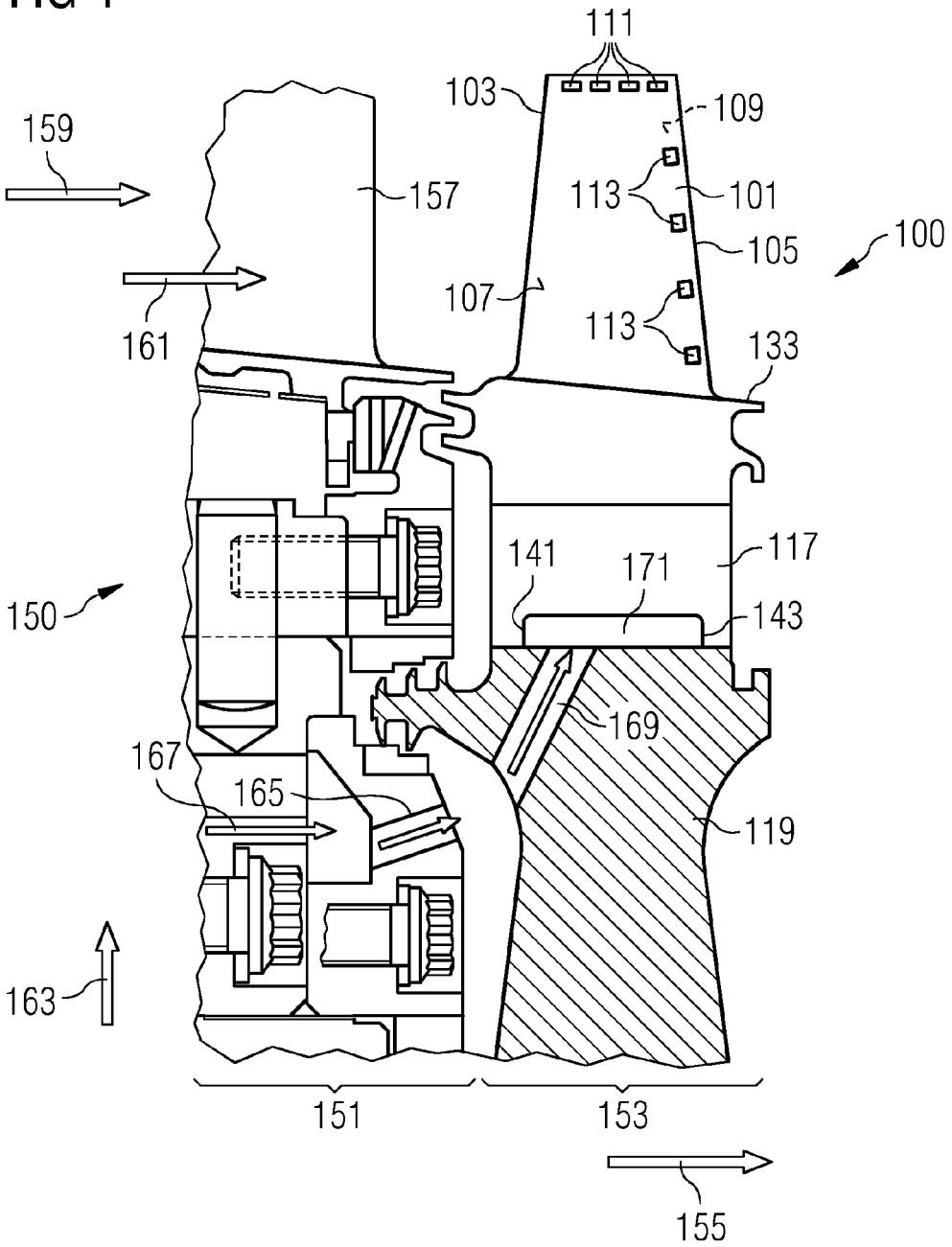
FIG. 1 schematically illustrates a cross-sectional view of a portion of a gas turbine according to an embodiment of the present invention including a rotor blade according to an embodiment of the present invention.

The illustration in the drawings is in schematic form. It is noted that in different figures, similar or identical elements are provided with the same reference signs or with reference signs, which are different from the corresponding reference signs only within the first digit.

FIG. 1 schematically illustrates a cross-sectional view of a portion of a gas turbine 150 according to an embodiment of the present invention including a rotor blade 100 according to an embodiment of the present invention. The gas turbine 150 comprises a stator portion 151 and a rotor portion 153. The rotor portion 153 is designed to rotate around a rotation axis 155 relative to the stator portion 151.

The rotor blade 100 may be used to generate rotational energy from a hot burned combustion gas which has been burned in a combustor and which streams with high velocity and high temperature through the turbine to impact on the rotor blade to cause a rotation of the rotor blade, generating a torque that can be converted to mechanical work e g for driving a generator, a pump, a propeller or a compressor.

The stator portion 151 of the gas turbine 150 comprises a nozzle guide vane 157 for guiding working fluid 159 streaming in a direction 161 to a rotor blade 100 arranged axially downstream (wherein the rotation axis 155 denotes the axial direction) of the nozzle guide vane 157. In FIG. 1 reference sign 163 denotes a radial direction being perpendicular to the rotation axis 155.

The working fluid 159 impacts an airfoil section 101 comprised in the rotor blade 100. The impact of the working fluid 159 causes an energy transfer from the working fluid 159 to the airfoil section 101 of the rotor blade which causes the rotor blade to rotate around the rotation axis 155.

The airfoil section 101 of the rotor blade 100 comprises a leading edge 103, a trailing edge 105, a pressure surface 107 and a suction surface 109. Further, the airfoil section 101 comprises a number of cooling exit holes 111 arranged at a tip of the rotor blade and a number of cooling fluid exit holes 113 located at the trailing edge 105 of the airfoil section 101 of the rotor blade 100.

The rotor blade 100 further comprises a root section 117 of the rotor blade 100 which connects the blade 100 to a disk 119 which is connected to a not illustrated rotation shaft. The blade 100 of the type shown in FIG. 1 comprises three main parts/portions/sections, the airfoil section 101, the platform section 133 and the root section 117. The airfoil section 101, protruding into the path of the working fluid is in most cases integral to the platform section 133, i.e. the radially inner boundary/wall of the path of the working fluid. Radially inwards of the platform section 133 is the blade root section 117, integral with the airfoil, which attaches the blade to the disk 119.

For cooling the inside of the airfoil section 101 of the rotor blade with a cooling fluid (in particular compressed air) the stator portion 151 comprises a cooling fluid entry or cooling fluid channel 165 through which cooling fluid 167 is introduced into a cooling supply conduit 169 within the disk 119. The cooling supply conduit 169 supplies the cooling fluid 167 towards a cooling fluid entry plenum 171 comprised in the root section 117 of the rotor blade 100. The cooling fluid entry plenum 171 is delimited by a plenum upstream border 141 and a plenum downstream border 143. The root section 117 of the rotor blade 100 comprises internally cooling passages which are not illustrated in FIG. 1 but which are described in more detail with reference to FIGS. 2 and 3.

Figure 2:
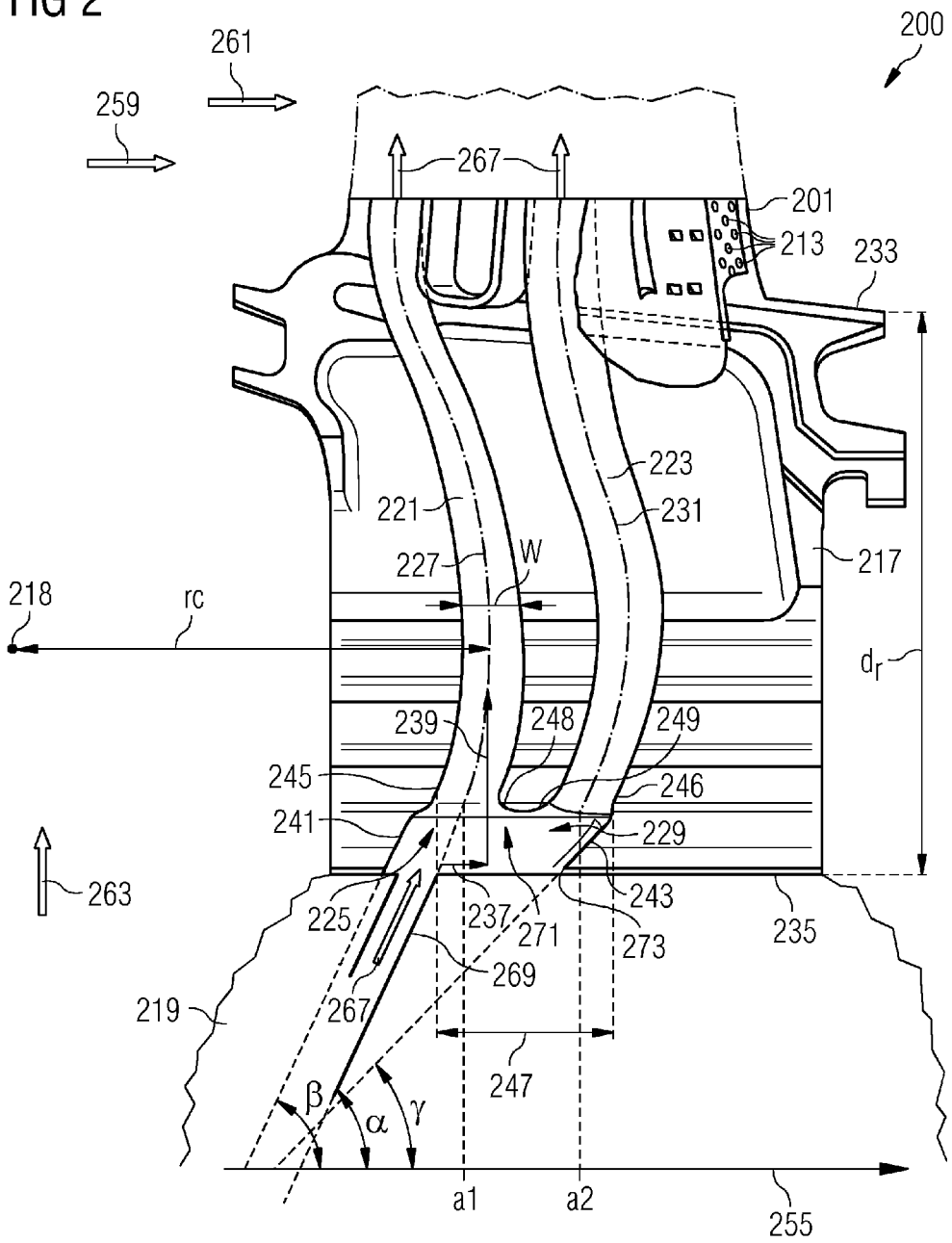
FIG. 2 schematically illustrates a cross-sectional view of a portion of a rotor blade according to an embodiment of the present invention which may be used in the gas turbine depicted in FIG. 1.

FIG. 2 schematically illustrates a cross-sectional view (representing an azimuthal plane or a set of points having same circumferential positions) of a portion of a rotor blade 200 according to an embodiment of the present invention.

The rotor blade 200 comprises an airfoil portion 201 from which in FIG. 2 only a small portion is illustrated. In the complete rotor blade 200 the airfoil portion 201 extends further in the radial direction 263 comprising features as is illustrated for the rotor blade 100 depicted in FIG. 1. In particular, the airfoil section 201 of the rotor blade 200 illustrated in FIG. 2 comprises a cooling channel system which is provided with cooling fluid via the cooling passages of the root section 217 of the rotor blade 200. Via cooling exit apertures, downstream of the pedestals 213 the cooling fluid after having absorbed a portion of the heat energy received by the airfoil section 201 exits the inside of the airfoil section 201 of the rotor blade 200.

The root section 217 of the rotor blade 200 comprises an upstream cooling passage 221 and a downstream cooling passage 223. The upstream cooling passage 221 has an entry 225 and is located at a first axial position a1, wherein a center line 227 of the upstream cooling passage is indicated.

The downstream passage 223 has an entry 229 at a second axial position a2, wherein the second axial position a2 is downstream of the first axial position a1 (i.e. a2>a1). Further, a center line 231 of the downstream cooling passage is indicated. The cooling passages 221, 223 are denoted upstream cooling passage and downstream cooling passage, since the upstream cooling passage is located upstream relative to the downstream cooling passage 223, when distinguished with respect to the streaming direction 261 of the working fluid 259.

The upstream cooling passage 221 as well as the downstream cooling passage 223 are curved cooling passages, wherein a radius of curvature rc is indicated for the upstream cooling passage 221. The center of curvature 218 for the upstream cooling passage 221 is axially located upstream of the cooling passage 221 and radially between the radially outer portion (or platform) 233 of the root section 217 and the radially inner portion 235 of the root section 217. The radius of curvature rc is related to the radial distance dr between a platform 233 of the rotor blade 200 and a radially inner end 235 of the root section 217 of the rotor blade 200. In particular, it holds 0.25*dr<rc<1.5*dr, wherein in the present case as illustrated in the example of FIG. 2, rc amounts to about dr.

As can be seen from FIG. 2 the radius of curvature of the upstream cooling passage 221 is approximately constant along an extent of the upstream cooling passage 221. Further, the downstream cooling passage 223 has about the same radius of curvature as the upstream cooling passage 221. Further, an axial width W (and/or a cross-sectional area) of the upstream cooling passage 221 may not deviate more than 20% of an axial width (and/or a cross-sectional area) of the downstream cooling passage 223.

As can be seen from FIG. 2, the upstream cooling passage 221 as well as the downstream cooling passage 223 penetrates through the platform 233, in order to supply the cooling fluid 267 to an inside of the airfoil section 201 of the rotor blade 200, in order to cool the airfoil section 201 internally.

The root section 217 of the rotor blade 200 is connected to the disk 219 in a similar way as is depicted in the embodiment illustrated in FIG. 1. The disk 219 comprises a cooling supply conduit 269 for supplying the cooling fluid 267 towards a cooling fluid entry plenum 271 which is formed within the root section 217 of the rotor blade 200. The supply conduit 269 of the disk 219 includes an angle α with the axial direction 255, wherein α may for example amount to about 73°.

When entering the upstream cooling passage 271 in a first portion thereof, the cooling fluid has a movement component 237 in the axial direction 255 and a movement component 239 in the radial direction 263. As the blade root 217 and thereby the blade 200 is typically installed at an angle relative to the axial direction 255 (i.e. rotated around the radial axis 263) the cooling fluid 267 may also have a small tangential or circumferential movement component. When the cooling fluid 267 proceeds or flows through the upstream cooling passage 221 the component 237 of movement in the axial direction 255 decreases to become zero in about half a way from the radially inner end 235 of the root section 217 to the radially outer end 233 of the root section 217. Beyond that the moving cooling liquid will gain a movement component in a direction opposite to the axial direction 255, while the component 239 in the radial direction 263 remains.

The cooling fluid entry plenum 271 is delimited by a plenum upstream border 241 and a plenum downstream border 243 which have an axial distance from each other which corresponds to a distance (denoted as 247) between an upstream border 245 of the upstream cooling passage 221 and a downstream border 246 of the downstream cooling passage 223.

The plenum upstream border 241 includes an angle β with the axial direction 255 and the plenum downstream border 243 includes an angle γ with the axial direction 255, wherein β is greater than γ. A plenum central border is formed by a downstream border 248 of the upstream cooling passage 221 and a upstream border 249 of the downstream cooling passage 223, wherein a fillet radius of curvature at the downstream border 248 of the upstream cooling passage 221 is smaller than the fillet radius of curvature at the upstream border of the downstream cooling passage 223.

As can be seen from FIG. 2, the center line 227 of the upstream cooling passage 221 has, at the entry 225, a same orientation as the cooling fluid supply conduit 269 such that they align. Further, the angle β of the upstream border of the plenum 271 equals the angle α of the inclination of the cooling fluid supply conduit 269 of the disk 219.

In particular, when the cooling air 267 is fed via a hole 269 in the disk rim 219 the angle of the opposing inlet passage (the upstream cooling passage 221) is aligned with the angle α of the disk hole 269.

In particular, the downstream border of the plenum 271 is sloped away from the direction of the cooling fluid 267. In particular, the angle between the base 235 of the root section and the border 243 may be between 20° and 80°. The face of the border 243 may be curved or flat. The corner radius between the downstream passage 223 and the plenum 271 is locally increased in size.

Figure 3:
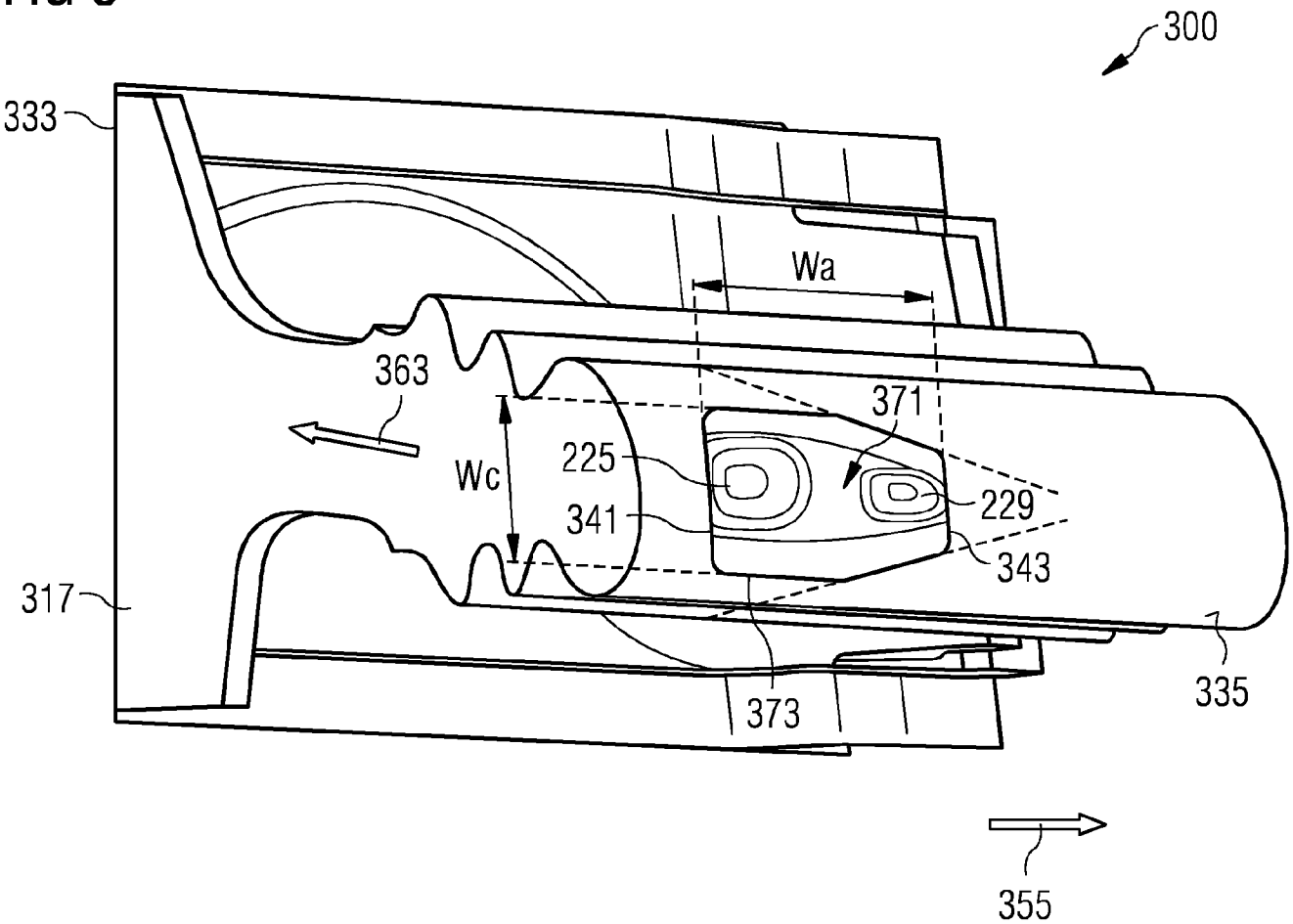
FIG. 3 schematically illustrates a perspective view of the portion of the rotor blade illustrated in FIG. 2.

FIG. 3 schematically illustrates a perspective view of the portion of the rotor blade 200 illustrated in FIG. 2 as rotor blade 300. The blade 300 includes a platform 333 that is similar to the platform 233 of the blade 200. The axial direction 355 and the radial direction 363 are indicated such that the view of FIG. 3 is almost along the radial direction 263. Thereby, the cooling fluid entry plenum 371 of the root section 317 of the rotor blade 300 is visible.

In particular, the cooling fluid entry plenum 371 is at a radially inner end delimited by an entry aperture 373. The cooling fluid entry plenum 371 is also delimited by a plenum upstream border 341 and a plenum downstream border 343. As can be seen from FIG. 3, a circumferential width $W_c$ of the entry aperture 373 decreases in the axial direction 355 such that the circumferential width is smaller at the downstream end of the entry aperture 373 than at the upstream end of the entry aperture 373. An axial width $W_a$ of the cooling fluid entry plenum 371 is also depicted and is measured in the axial direction 355. What is also visible in FIG. 3 are the entry ports 225 and 229 of the upstream cooling passage 221 and the downstream cooling passage 223, respectively.

The cooling passages 221, 223 provide profiles which are shaped in order to help convert highly swirled cooling air 267 contained within the cavity or plenum at the base of the blade into radial momentum required in order to improve the effectiveness of the blade cooling air system.

In particular, the angling of the plenum cavity walls or the borders of the entry plenum 271, 371 and the sloping of the plenum downstream face negates the tendency for flow to locally swirl causing the formation of vortices and the base of the downstream blade cooling air inlet passage. Elimination of this vortex may cause a reduction in pressure loss, thus enabling increased cooling air mass flow.

The effect of removing the flow vortex in the downstream inlet passage may cause the flow from the disk cooling hole 169, 269 to become less swirled, as more flow is provided to the downstream inlet.

Less swirl in the disk cooling hole may cause reduced swirl in the upstream inlet passage. The vortex is further weakened by the use of the curved passages 221, 223 and other features. The same features may also reduce the flow separation and the upstream inlet cooling flow passage entry. The combined effect is to reduce the pressure loss and increase the air mass flow into the passage. It is apparent that for a given passage cross-sectional area, a significant reduction in pressure loss may be enabled. This may be exploited by improved aerofoil cooling, i.e. achieve lower metal temperatures or by employing narrower cooling passages in the blade root for the benefit of root stresses.

It has to be noted that according to this text the axial direction of the root section or the rotor blade is defined as the direction of a rotational axis which is present once the root section or the rotor blade is assembled to a turbo machine, particularly a gas turbine engine. Particularly the axial direction corresponds to the direction of the main fluid flow. In other words, the axial direction is defined as a direction from an upstream end of the rotor blade to the downstream end. In regards of the radial direction, again this direction is defined for the root section or the rotor blade that assembled to a turbo machine. The radial direction is the direction perpendicular to an axis of rotation of the turbo machine. The radial direction may be defined as the direction from a bottom of the root section in direction of the main direction of the cooling fluid flow.

Working fluid may be a term for a main hot fluid flowing through a main fluid path into which aerofoils of rotor blades or aerofoils of stator vanes extend. The working fluid may be guided through an annular passage, the annular passage being limited amongst others by the platform of the rotor blade.

The fluid flow of the cooling fluid may be defined as a vector in a three dimensional space. The orientation of the vector may be defined via three components which may be called movement component. The direction of the fluid flow may be given by adding—i.e. vector adding—the movement components using vector algebra.

In more abstract words, an embodiment of the invention is directed to a rotor blade comprising a curved cooling passage located inside a root section of the rotor blade for guiding a cooling fluid within the root section from a bottom end of the root section in direction of an aerofoil of the rotor and further comprising a cooling fluid entry plenum having an entry aperture with a corresponding curvature as the bottom end of the curved cooling section. Particularly the feed for the cooling passage is provided from cooling air which is injected inclined from an upstream direction. To provide an inclined injection particularly a rotor disk into which the rotor blade is inserted may have a disk passages through the rotor disk from an upstream side face of the rotor disk to a slot of the rotor disk such that the disk passage has the same inclination as the curvature of the bottom end of the rotor blade. This allows a smooth injection of cooling fluid such that air can be injected without pressure losses.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A root section of a rotor blade for interacting with working fluid upon rotating the rotor blade about a rotation axis oriented in an axial direction, the working fluid streaming in the axial direction, the root section of the rotor blade comprising:

a curved cooling passage in an inside of the root section for guiding a cooling fluid within the root section from a radially inner end of the root section to a radially outer end of the root section, wherein a radial direction is perpendicular to the axial direction and pointing away from the rotation axis;

a cooling fluid entry plenum having an entry aperture arranged at the radially inner end of the root section for introducing the cooling fluid into the curved cooling passage; and a platform located at a radially outer end of the root section, the platform being in contact with the working fluid, wherein the curved cooling passage penetrates through the platform, wherein the following condition is satisfied in a portion ranging from 70% to 100% of a radial extent of the curved cooling passage:

$$0.25*dr<rc<1.5*dr;$$

wherein dr is a radial distance in the radial direction between the platform of the root section and the entry aperture of the cooling fluid entry plenum and rc is the radius of curvature of the curved cooling passage, wherein the cooling fluid is guided within the curved cooling passage from the radially inner end to the radially outer end of the root section such that the cooling fluid has a movement component in the axial direction and a movement component in the radial direction in a first, radially inner portion of the curved cooling passage, the cooling fluid has a movement component only in the radial direction in a second, radially middle portion of the curved cooling passage, and the cooling fluid has a movement component in a direction opposite to the axial direction and in the radial direction in a third, radially outer portion of the curved cooling passage.

2. The root section according to claim 1, wherein the portion ranging from 70% to 100% of the radial extent of the curved cooling passage is located in a single azimuthal plane.

3. The root section according to claim 1, wherein the curved cooling passage comprises an upstream cooling passage and a downstream cooling passage, the downstream cooling passage being located axially downstream from the upstream cooling passage.

4. The root section according to claim 3, wherein the upstream cooling passage and the downstream cooling passage have cross-sectional areas at same radial positions, said cross-sectional areas differ in a range from 0% to 20%, wherein the cross-sectional area of the upstream cooling passage varies along the radial extent of the upstream cooling passage in a range from 25% to 0% of an average cross-sectional area of the upstream cooling passage taken along the entire extent of the upstream cooling passage.

5. The root section according to claim 4, wherein the range of the respective cross-sectional areas differs from 0% to 10%, and the range of the cross-sectional area of the upstream cooling passage varies from 10% to 0% of the average cross-sectional area of the upstream cooling passage.

6. The root section according to claim 3, wherein the entry aperture has a shape being elongated in the axial direction to have an axial width (Wa) in a range from 1.2 to 2.0 times greater than a circumferential width (Wc), wherein the entry aperture tapers in the axial direction such that a circumferential width (Wc) of the entry aperture decreases in the axial direction such that the circumferential width of the entry aperture at a downstream end of the entry aperture ranges from 0.9 to 0.4 of a circumferential width of the entry aperture at an upstream end of the entry aperture.

7. The root section according to claim 6, wherein the axial width (Wa) of the entry aperture deviates from an axial distance determined at a same radial position, between an upstream border of the upstream cooling passage and a downstream border of the downstream cooling passage in a range from 0% to 30% of the axial distance between the upstream border of the upstream cooling passage and the downstream border of the downstream cooling passage.

8. The root section according to claim 3, wherein the cooling fluid entry plenum and the entry aperture are delimited by a plenum upstream border which joins with an upstream border of the upstream cooling passage and are delimited by a plenum downstream border which joins with a downstream border of the downstream cooling passage, wherein the plenum upstream border includes an angle (β) with the axial direction which is greater than an angle (γ) which the plenum downstream border includes with the axial direction.

9. The root section according to claim 8, wherein the plenum upstream border includes the angle (β) with the axial direction ranging from 65° to 80°, wherein the plenum downstream border includes the angle (γ) with the axial direction ranging from 20° to 80°.

10. The root section of claim 9, wherein the range of the angle (γ) with the axial direction extends from 35° to 60°.

11. The root section according to claim 3, wherein the cooling fluid entry plenum is radially outwards delimited by a plenum central border, wherein the plenum central border joins a downstream border of the upstream cooling passage at an upstream fillet radius of curvature, wherein the plenum central border joins an upstream border of the downstream cooling passage at a downstream fillet radius of curvature, wherein the downstream fillet radius of curvature comprises a range from 1.5 times to 5 times greater than the upstream fillet radius of curvature.

12. The root section according to claim 11, wherein the range of the downstream fillet radius of curvature extends to 3 times greater than the upstream fillet radius of curvature.

13. The root section according to claim 12, wherein the range of the downstream fillet radius of curvature extends to 2 times greater than the upstream fillet radius of curvature.

14. The root section according to claim 1, wherein the following condition is satisfied:

$$0.5*dr<rc<1.25*dr.$$

15. A rotor blade for interacting with and being driven by working fluid upon rotating about a rotation axis oriented in an axial direction, the working fluid streaming in the axial direction, the rotor blade comprising:

a root section, as recited in claim 1; and an airfoil section fastened at the radially inner end of the root section and extending in the radial direction, the airfoil section being arranged for interacting with the working fluid.

16. A rotor blade arrangement, comprising:

a rotor blade according to claim 15; and a disk connectable to a rotor shaft, the disk comprising a cooling supply conduit for supplying the cooling fluid into the upstream cooling passage of the root section of the rotor blade, wherein the rotor blade is mechanically connected to the disk via the root section of the rotor blade such that the plenum upstream border and a supply conduit upstream border align.

17. The rotor blade arrangement according to claim 16, wherein an orientation of the cooling supply conduit of the disk aligns in a range from 0° to 10° from an orientation of the upstream cooling passage of the root section of the rotor blade.

18. A method for supplying a cooling fluid to a rotor blade, the rotor blade being adapted for interacting with working fluid upon rotating about a rotation axis oriented in an axial direction, the working fluid streaming in the axial direction, the method comprising:

guiding the cooling fluid within a curved cooling passage in an inside of a root section of the rotor blade from a radially inner end of the root section to a radially outer end of the root section, wherein a radial direction is perpendicular to the axial direction pointing away from the rotation axis;

introducing the cooling fluid into the curved cooling passage via a cooling fluid entry plenum having an entry aperture arranged at the radially inner end of the root section; and leading the cooling fluid through a platform located at a radially outer end of the root section, the platform being in contact with the working fluid, wherein the curved cooling passage penetrates through the platform, wherein the following condition is satisfied in a portion in a range from 70% to 100% of a radial extent of the curved cooling passage:

$$0.25*dr<rc<1.5*dr, \text{ wherein}$$

dr is a radial distance in the radial direction between the platform of the root section and the entry aperture of the cooling fluid entry plenum and rc is the radius of curvature of the curved cooling passage, wherein the cooling fluid is guided within the curved cooling passage from the radially inner end to the radially outer end of the root section such that the cooling fluid has a movement component in the axial direction and a movement component in the radial direction in a first, radially inner portion of the curved cooling passage, the cooling fluid has a movement component only in the radial direction in a second, radially middle portion of the curved cooling passage, and the cooling fluid has a movement component in a direction opposite to the axial direction and in the radial direction in a third, radially outer portion of the curved cooling passage.

* * * * *